US011155371B2

(12) United States Patent
Sternberger-Rützel et al.

(10) Patent No.: US 11,155,371 B2
(45) Date of Patent: Oct. 26, 2021

(54) DEVICE FOR THE DOSED FILLING OF A CONTAINER WITH A FILLING MATERIAL

(71) Applicant: DS-Technology GmbH, Winnenden (DE)

(72) Inventors: Elke Sternberger-Rützel, Allmersbach im Tal (DE); Philipp Gaus, Allmersbach im Tal (DE); Michael Röhrle, Allmersbach im Tal (DE)

(73) Assignee: DS-Technology GmbH, Winnenden (DE)

( * ) Notice: Subject to any disclaimer, the term of this patent is extended or adjusted under 35 U.S.C. 154(b) by 0 days.

(21) Appl. No.: 16/977,432

(22) PCT Filed: Mar. 7, 2018

(86) PCT No.: PCT/DE2018/000056

§ 371 (c)(1),
(2) Date: Sep. 1, 2020

(87) PCT Pub. No.: WO2019/170180

PCT Pub. Date: Sep. 12, 2019

(65) Prior Publication Data

US 2021/0002006 A1 Jan. 7, 2021

(51) Int. Cl.

| | |
|---|---|
| ***B65B 1/36*** | (2006.01) |
| ***A61J 3/07*** | (2006.01) |
| ***A61J 7/00*** | (2006.01) |

(52) U.S. Cl.

CPC ..... *B65B 1/36* (2013.01); *A61J 3/074* (2013.01); *A61J 7/0038* (2013.01)

(58) Field of Classification Search

CPC ..... B65B 1/36; A61J 3/074; A61J 7/0038

USPC ..... 141/1

See application file for complete search history.

(56) References Cited

U.S. PATENT DOCUMENTS 1,254,115 A * 1/1918 Brand ..... A47G 21/183 206/217
1,885,201 A * 11/1932 Holley ..... G07F 11/44 222/153.09
1,904,756 A * 4/1933 Wooster ..... A47K 5/10 222/336

(Continued)

FOREIGN PATENT DOCUMENTS

DE 202013005759 U1 7/2013
EP 1843683 B1 11/2010

*Primary Examiner* — Timothy L Maust
*Assistant Examiner* — James R Hakomaki
(74) *Attorney, Agent, or Firm* — Smartpat PLC

(57) ABSTRACT

A device for the dosed filling of a container with a filling material has a holding unit for holding the container and a filling unit by which a defined amount of filling material is withdrawn from a material store and transferred into the container. The filling unit has a dosing chamber. The dosing chamber is mounted displaceably alternately between a first position and in a second position. In its first position, the dosing chamber is in contact with the material store so that filling material can be transferred out of the material store into the dosing chamber. In its second position, the dosing chamber is situated above the container so that the filling material in the dosing chamber can be emptied into the container. The material store is in the form of a separate container and can be fastened detachably to the device by a fastening unit.

8 Claims, 2 Drawing Sheets

(56) References Cited

U.S. PATENT DOCUMENTS 2,259,710 A * 10/1941 Stern ..... A47G 19/34 222/41
2,315,473 A * 3/1943 Wolcott ..... G01F 11/24 222/248
3,179,304 A * 4/1965 Heilbrunn ..... B65B 1/363 222/267
3,185,190 A * 5/1965 Crawford ..... G01F 11/18 141/360
3,193,159 A * 7/1965 Swindler ..... G01F 11/18 222/336
3,204,833 A * 9/1965 Weitzner ..... G01F 11/24 222/355
3,380,633 A * 4/1968 DuBois ..... F42B 33/0292 222/137
3,554,412 A * 1/1971 Hayashi ..... G01F 11/10 222/346
3,757,943 A * 9/1973 Chae ..... A61J 3/074 209/551
4,019,660 A * 4/1977 Berkey ..... A47G 19/34 222/304
4,186,646 A * 2/1980 Martin ..... F42B 33/0292 86/28
4,387,809 A * 6/1983 Botzler ..... A47G 21/004 206/216
4,403,715 A * 9/1983 Ludovissie ..... A47G 19/34 222/361
4,733,803 A * 3/1988 Sisson ..... B65B 1/36 137/246.11
4,792,333 A * 12/1988 Kidder ..... A47G 21/183 604/83
4,939,884 A * 7/1990 Peters ..... B65B 3/16 141/144
5,544,684 A * 8/1996 Robinette, III ..... G01G 17/06 141/100
5,626,171 A * 5/1997 Mirri ..... A61J 3/074 141/145
5,718,681 A * 2/1998 Manning ..... A47G 21/183 239/33
5,971,037 A * 10/1999 Ansaloni ..... A61J 3/074 141/100
6,638,549 B1 * 10/2003 Lloyd ..... B65D 75/12 426/115
6,749,091 B2 * 6/2004 Connelly ..... G01F 11/16 222/181.1
7,047,709 B2 * 5/2006 Hamilton ..... B65B 3/16 53/250
8,157,129 B2 * 4/2012 Kawanishi ..... G01G 19/393 222/56
9,271,590 B2 * 3/2016 Ecseri ..... A47G 21/183
9,296,501 B2 * 3/2016 Haberstroh ..... B65B 27/12
2005/0113746 A1 * 5/2005 Sedaghat Kerdar ..... A47G 21/183 604/77
2005/0249031 A1 * 11/2005 Morgese ..... G09F 3/00 366/129
2007/0068959 A1 * 3/2007 D'Silva ..... G07F 17/0092 221/7
2007/0169836 A1 7/2007 Djurle et al.
2007/0262164 A1 * 11/2007 Gelfand ..... A61J 7/0038 239/33
2008/0011869 A1 1/2008 Sternberger et al.
2010/0101189 A1 * 4/2010 Boldrini ..... B65B 1/46 53/451
2012/0041778 A1 * 2/2012 Kraft ..... A61J 3/074 705/2

* cited by examiner

DEVICE FOR THE DOSED FILLING OF A CONTAINER WITH A FILLING MATERIAL

TECHNICAL FIELD

The disclosure relates to a device for the metered filling of a container with a pourable or flowable filling material. Such devices are used, in particular, when producing nutritional supplements or medicaments. In these cases, a filling material containing an active substance is filled into a suitable container so that the filling material and thus also the active substance may be swallowed, for example, as a capsule.

BACKGROUND

Depending on the type of metering, two main groups of preparations of active substances are known. Firstly, the active substance may already be correctly pre-metered, for example in the form of tablets, filled hard gelatine capsules or injection ampoules. In this case, each unit of the preparation already contains the correct, predetermined dose of the active substance. Secondly, preparations exist in non-metered form from a reservoir (container), for example in the form of ointments, powders, granules or pellets. In this case, the respectively required quantity of product and thus also of active substance is taken individually. If the respective active substance has a large therapeutic window, the patient and/or consumer may take such an individual dose directly. If the active substance, however, has only a very narrow therapeutic window—i.e. the boundary between a dose which is as yet ineffective and a dose which already causes undesirable side effects is very small—the patient should no longer take the active substance individually in an uncontrolled manner.

Preparations comprising pre-metered active substances are produced, in particular, on an industrial scale when the respective dosage is to be provided in a large quantity. This is the case, for example, for antibiotics. Other treatments, however, require a dosage which is individual to the patient and which, for example, relates to the respective body weight. In this case, industrial production is generally cost-intensive and thus economically inefficient. Thus individual metering is generally performed in the pharmacy or hospital pharmacy. For example, a series of oncology drugs and psychotherapeutic drugs has to be metered individually. Specifically in geriatrics and paediatrics relatively conventional medicaments such as antibiotics frequently also have to be metered individually. This is required in order to take account of the differences in body weight and in physical condition and in some cases also in order to take account of the specific metabolism in small children.

When metering an active substance to be individually dispensed to a patient, this is generally weighed out in the hospital pharmacy, for example. Alternatively, a specific volume of the active substance which corresponds to the required dose of the active substance may also be measured out. In order to simplify the intake for the patient, the individual dose is frequently filled into hard gelatine capsules. Such capsules which are assembled from a capsule lower part and a capsule upper part are a common means of administering powdery or pellet-shaped active substances. They may be produced and filled on an industrial scale in very large quantities but may also be used in pharmacies for producing separate individual doses.

Nowadays, drinking straws are also used for administering active substances and/or food supplements. Such a drinking straw is disclosed, for example, in EP 1 843 683 B1. The active substance is present, in particular, in this case in the form of granules, pellets, microtablets or powders, and preferably has a size in the range of approximately 250 micrometres up to 4 millimetres. The average size is approximately 250 micrometres up to 710 micrometres. The active substance in this case is already located in the drinking straw and is suctioned with a liquid from the drinking straw into the mouth of the patient and subsequently swallowed. This makes it easier for the patient to take the active substance since generally it may be swallowed much more easily. This may be advantageous, in particular, in patients with swallowing difficulties (for example in paediatrics and/or geriatrics). By taking the active substance as an in situ suspension with the liquid, the taste of the active substance, for example, may be masked by the liquid. The patient may adapt the taste as desired by different beverages. With the use of pellets these are generally functionally coated. In this manner, a masking of the taste may also be possible. Moreover, a specific release profile may also be obtained. The drinking straws are generally produced on an industrial scale and, therefore, contain an accurately predetermined dose of an active substance.

SUMMARY

An object of the disclosure is to provide an improved device for the metered filling of a container with a filling material containing an active substance, which in particular permits individual filling of the containers directly at the point of care. In this case, in particular, smaller quantities of containers are designed to be able to be filled cost-effectively, rapidly and reliably.

The device for the metered filling of a container with a filling material comprises a receiving unit for receiving the container to be filled and a filling unit. A defined quantity of filling material is able to be removed from a material store and transferred into the container by means of the filling unit. For this purpose, the filling unit comprises at least one metering chamber which is displaceably mounted. As a result, the at least one metering chamber may be present alternately in a first position and in a second position. In its first position, the metering chamber is in contact with the material store so that filling material is able to be filled into the metering chamber from the material store. In its second position, the metering chamber is arranged above the container to be filled, so that the filling material located in the metering chamber is able to be emptied into the container. The material store is present as a separate container which can be fastened detachably to the device by means of a fastening unit.

Through the use of a separate container as material store, the device can be used directly at the place of administration (point of care) of the active substance. The patient can be given a medical prescription for a certain number of containers to be filled and for a certain quantity of active substance. The patient is issued with the containers and the active substance from a pharmacy or a hospital pharmacy, the active substance being held in storage in a suitable container. At the same time, the patient is informed of the required dose of the active substance. The appropriately trained patient or a carer (for example also the appropriately trained parents of sick children) can then accordingly fill the containers directly before use and then also administer them.

The metering chamber may be displaceable, in particular, in the forward direction and in the opposing direction thereto. Such a movement to and fro may generally be carried out using just one hand and provisional positioning and handling is generally not required at the same time. This simplifies the operation of the device for the person carrying out the filling procedure.

In a first embodiment, the device may have merely the above-described one metering chamber. In this case, it would be necessary to perform the forward movement and rearward movement in order to complete a filling procedure. Preferably, in this case the metering chamber may be mounted so as to be longitudinally displaceable. Such a mounting is able to be implemented in a structurally simple manner and at the same time permits a simple and convenient operation.

In a second embodiment, the device may comprise a first metering chamber and a second metering chamber. The two metering chambers in each case may be present alternately in a first position and in a second position. Whilst one of the two metering chambers is in its first position and is filled with the filling material to be filled, the second of the two metering chambers is in its second position and empties the filling material located in the metering chamber into the container. In their second position, both metering chambers have to be present in an identical position above the container in order to permit an exact and reproducible filling of the container. The first position of the two metering chambers, however, may be different, as long as both metering chambers are able to be filled in their respective first position with the same quantity of the same filling material.

In an embodiment which is particularly simple structurally, the two metering chambers are displaceable in each case from their first position into their second position by a rotational movement. If the rotational movement in this case respectively encloses an angle of 180 degrees, the two metering chambers may be exactly exchanged in their positions by the rotational movement. In this case, the two metering chambers would be present in their second position at identical positions below the material store.

In order to prevent when emptying the metering chamber that a portion of the filling material falls to the side of the container, a funnel element may be arranged between the at least one metering chamber and the upper edge of the container.

The fastening unit for the material store can preferably have a screw closure or a latching closure. When a screw closure is used, the containers used as a material store can be securely closed with a screw lid and, after removal of the screw lid, can also be fastened with the same thread to the screw closure of the device. In this way, existing standard containers already used in the prior art for the storage and transport of small quantities of filling material can continue to be used. Alternatively to this, containers with a click-on lid could also be used as before, provided that the device is equipped with a corresponding latching closure.

In a particularly preferred embodiment, the container may be configured as a drinking straw. The drinking straw should in this case be already sealed at its lower end by suitable means so that the filling material may not fall down out of the drinking straw. After removing the drinking straw from the device, this drinking straw may be closed by means of a separate cap. By means of the device, therefore, it is possible to fill small quantities of drinking straws individually directly at the point of care. This permits new applications of drinking straws in administering active substances to patients.

Preferably, the device may have a counting unit. By means of the counting unit, the number of changes in position of the at least one metering chamber may be counted and displayed. Generally, a container is filled with several doses of filling material. The active substance, therefore, is generally present in a relatively small concentration in the filling material, so that different doses of active substance may be achieved by filling a defined number of metering chamber fillings with filling material. At the same time, the counting unit may prevent errors during the filling procedure, which may occur for example by the operator being distracted.

In a particularly preferred embodiment, a printer unit may be present. An automatic record-keeping of the filling procedure is possible by means of the printer unit. This may be carried out retrospectively or at the same time as the filling procedure.

The device is not limited to any specific type of filling material. In principle, any material may be regarded as filling material provided it may be divided into units which all have substantially the same quantity of active substance. This is the case, in particular, of such solid materials which are present in the form of granules, pellets or microtablets. In principle, liquids may also be correspondingly metered, in particular when these liquids are present in the form of microcapsules. The invention is of significance, in particular, in the case of filling materials with high-value active substances, so as not to drive up costs unnecessarily for a treatment. An individual filling of the respectively required doses may also be advantageous in the case of active substances with a short storage life.

Further advantages and features of the invention are to be derived from the features also set forth in the claims and the following exemplary embodiments.

BRIEF DESCRIPTION OF THE DRAWINGS

The invention is described and explained hereinafter in detail with reference to exemplary embodiments shown in the drawings, in which.

DETAILED DESCRIPTION

Figure 1:
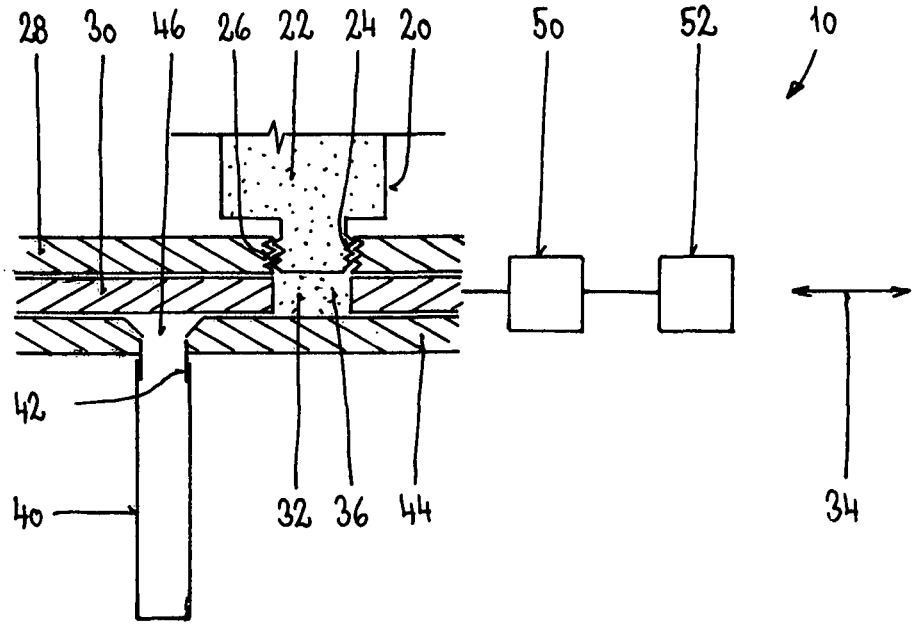
FIG. 1 shows a schematic longitudinal section through a first embodiment of the device for the metered filling of a container, in which the individual metering chamber is located in its first position below the material store.
Figure 2:
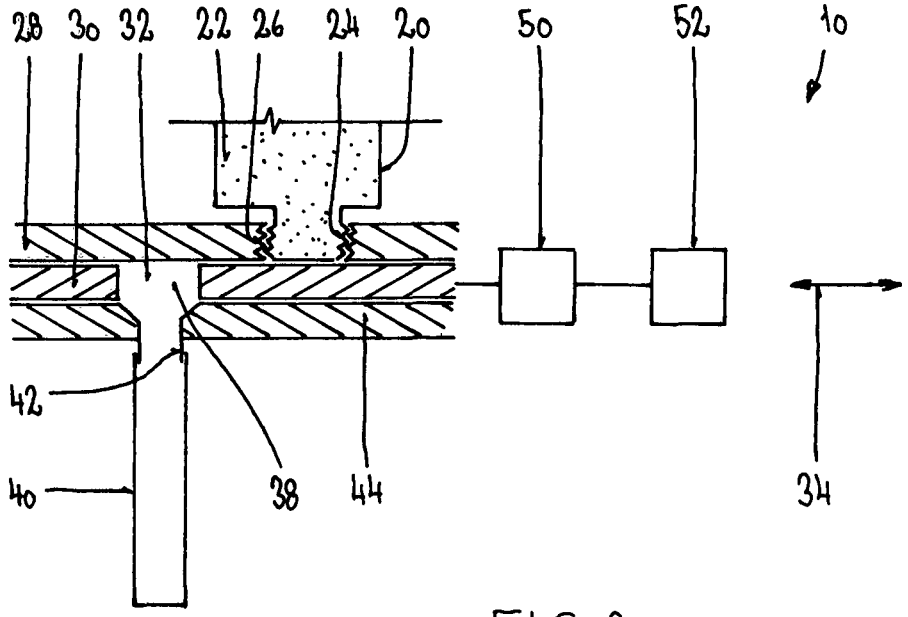
FIG. 2 shows a schematic longitudinal section through the device according to FIG. 1, in which the individual metering chamber is located in its second position above the container.

A first embodiment of the device 10 for the metered filling of a container is shown schematically in FIGS. 1 and 2. The device 10 has a container 20 as material store. In the container 20, a filling material 22 can be held in storage. The filling material 22 in the present exemplary embodiment is in the form of pellets which in each case contain a defined quantity of an active substance. Thus a uniform distribution may be achieved of the concentration of the active substance in the filling material 22.

In the present example, the container 20 has an outer thread 24. A screw lid (not shown here) can be fastened to the outer thread 24, provided that the container 20 is not fastened to the device 10. In order to fasten the container 20 to the device 10, the screw lid is removed, and the container 20 is screwed with the outer thread 24 into the inner thread 26 of the cover disc 28 of the device 10. For this purpose, the device 10 is normally turned such that the container 20 with the outer thread 24 faces upwards and the cover disc 28 with the inner thread 26 faces downwards. In this state, the device 10 can be fastened to the container 20 without the filling material 22 being able to trickle out of the container.

A metering disc 30 is located below the cover disc 28. In the present example, an individual metering chamber 32 is formed in the metering disc 30. The metering chamber 32 can receive a defined quantity of filling material 22. In the present example, the metering disc 30 can be moved to and fro in the longitudinal direction 34. In this way, the metering chamber 32 is transferred from its first position 36 shown in FIG. 1, underneath the material store 20, to a second position 38 shown in FIG. 2. From this second position 38, the metering chamber 32 can be moved back again to its first position 36.

In its second position 38, the metering chamber 32 is located above the opening of a container 40 that is to be filled. In the present example, the container 40 is designed as a drinking straw. The drinking straw 40 is fastened by its upper edge region to a receiving unit 42. In the present example, the receiving unit 42 has a protruding tube over which the upper edge region of the drinking straw can be pushed and can be fastened with frictional engagement. To be able to remove the drinking straw 40 after filling and replace it with a new, empty drinking straw, the drinking straw 40 simply has to be pulled down from the receiving unit 42. A new drinking straw 40 can then be fastened to the receiving unit 42. In the present example, the receiving unit 42 is present on a stationary plate 44 underneath the metering disc 30. A funnel element in the form of a funnel-shaped opening 46 is formed in this stationary plate 44. This funnel-shaped opening 46 leads directly into the receiving unit 42.

In the present example, the removal of the filling material 22 from the material store 20 is monitored by means of a counting unit 50. In the present example, the counting unit 50 determines the number of changes in position of the metering chamber 32. The counting unit 50 is connected to a printer unit 52. As a result, the result may be emitted via the printer unit 52 and thus recorded. In contrast to the exemplary embodiment shown here, the counting unit 50 and/or the printer unit 52 could also be dispensed with.

Figure 3:
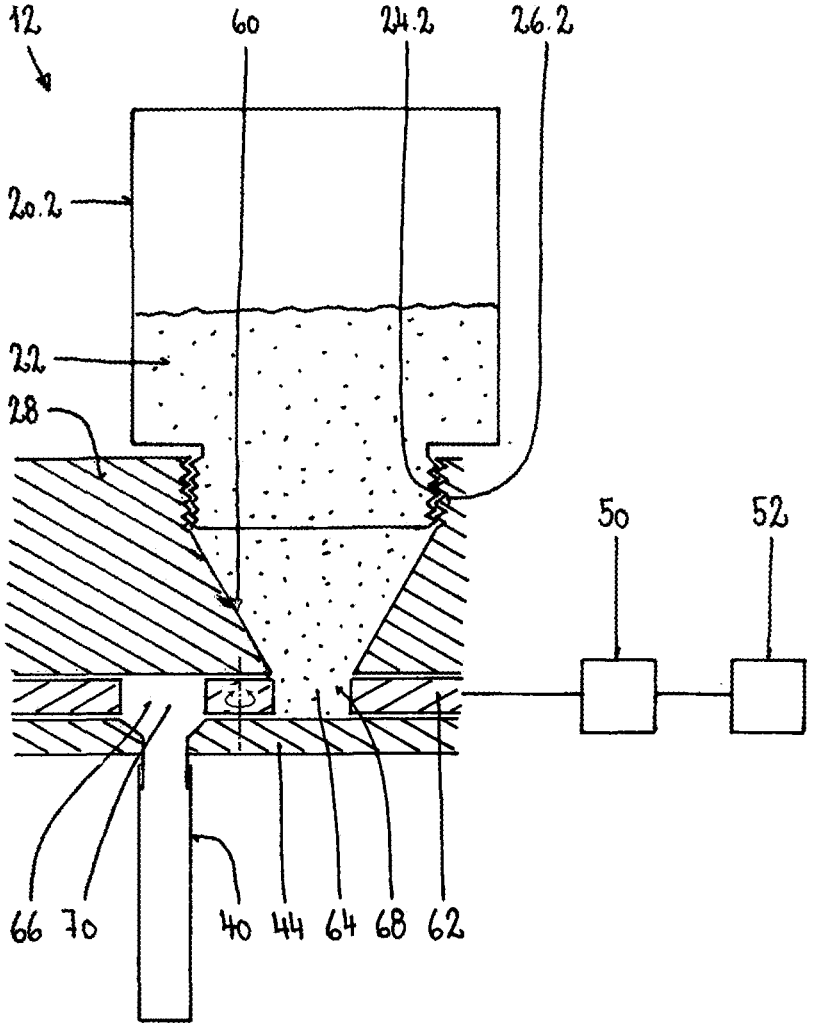
FIG. 3 shows a schematic longitudinal section through a second embodiment of the device, in which the first metering chamber is located in its first position below the material store and the second metering chamber is located in its second position above the container.

A second embodiment of the device 12 is shown schematically in FIG. 3. The device 12 likewise has a container 20.2 configured as a material store, in which a filling material 22 is held in storage. In the present example, the container 20.2 has an outer thread 24.2. A screw lid (not shown here) can be fastened to the outer thread 24.2, provided that the container 20.2 is not fastened to the device 12. In order to fasten the container 20.2 to the device 12, the screw lid is removed, and the container 20.2 is screwed with the outer thread 24.2 into the inner thread 26.2 of the cover disc 28.2 of the device 12. Whereas the container 20 according to FIGS. 1 and 2 was positioned directly above the metering chamber 32, the cover disc 28.2 of the device 12 according to FIG. 3 is considerably thicker. In this way, a funnel element 60 can be formed in the cover disc 28.2. By virtue of the funnel element 60, the opening of the container 20.2 can have a considerably greater diameter.

A metering disc 62 is located below the cover disc 28.2. In the present exemplary embodiment, two metering chambers 64, 66 are formed in the metering disc 62. The two metering chambers 64, 66 in each case may receive a specific quantity of filling material 22, wherein both metering chambers 64, 66 in each case may receive exactly the same quantity of filling material 22. The metering disc 62 in the present example may be rotated to and fro. Whilst in FIG. 3 the first metering chamber 64 is in its first position 68 below the material store 20, the second metering chamber 66 in FIG. 3 is in its second position 70 above the drinking straw 40 to be filled. After rotating the metering disc 62, the first metering chamber 64 would be located in its second position above the drinking straw 40 and the second metering chamber 66 in its first position below the material store 20.2. As in the case of the device 10 according to FIGS. 1 and 2, the device 12 according to FIG. 3 also has a stationary plate 44 with a funnel-shaped opening 46 and a receiving unit 42 for the drinking straw 40 below the metering disc 62.

In the present example, the removal of the filling material 22 from the material store 20.2 is monitored by means of a counting unit 50. In the present example, the counting unit 50 determines the number of changes in position of the two metering chambers 64, 66. The counting unit 50 is connected to a printer unit 52 corresponding to FIG. 3. The result may be output, therefore, via the printer unit 52 and thus recorded. In contrast to the exemplary embodiment shown here, the counter unit 50 and/or the printer unit 52 could also be dispensed with.

Generally, more than one filling of the metering chamber 32, 64, 66 is required in order to fill the desired quantity of filling material 22 and thus also the desired dose of active substance into the drinking straw 40. The metering disc 30, 62 is, therefore, generally repeatedly moved to and fro before the drinking straw 40 is removed. If the concentration of active substance in the filling material 22 is known, in this manner different quantities of active substance may be filled accurately.

If other quantities of filling material are to be filled, a replacement of the metering disc 30, 62 and thus an adaptation of the size of the metering chambers 32, 64, 66 may also be possible. Optionally, the adaptation of the size of the metering chambers 32, 64, 66 could also be implemented by different inserts in the metering disc 30, 62.

The invention claimed is:

1. A device for metered filling of a drinking straw with a medicament, comprising:

a receiving unit having a downwardly protruding tube for receiving the drinking straw with frictional engagement;

a fastening unit for detachably fastening a material store;

a filling unit, configured to remove a defined quantity of the medicament from the material store and transfer the defined quantity of the medicament into the drinking straw; and a counting unit, wherein the filling unit comprises at least one metering chamber, wherein the at least one metering chamber is rotatably mounted so that the at least one metering chamber is present alternately in a first position and in a second position, wherein in the first position the at least one metering chamber is in contact with the material store so that the medicament falls into the at least one metering chamber from the material store, wherein in the second position the at least one metering chamber is arranged above the drinking straw so that the medicament located in the at least one metering chamber falls into the drinking straw, and wherein the counting unit displays a number of changes in position of the at least one metering chamber.

2. The device according to claim 1, wherein the at least one metering chamber includes a first metering chamber and a second metering chamber, wherein the first metering chamber and the second metering chamber are arranged alternately in their respective first position and in their respective second position, and wherein the first metering chamber and the second metering chamber are arranged in their respective second position in an identical position above the drinking straw.

3. The device according to claim 2, wherein the first metering chamber and the second metering chamber are displaceable in each case from their respective first position into their respective second position by a rotational movement.

4. The device according to claim 1, further comprising a funnel element arranged between the at least one metering chamber and an upper edge of the drinking straw.

5. The device according to claim 1, wherein the fastening unit for the material store has an inner thread.

6. The device according to claim 1, further comprising a printer unit.

7. A device for metered filling of a drinking straw with a medicament, comprising:

a cover disc comprising an inner thread for receiving a medicament container having an outer thread;

a plate including a receiving unit having a downwardly protruding tube for receiving the drinking straw with frictional engagement;

a metering disc comprising a plurality of metering chambers rotatably arranged between the cover disc and the plate;

a first funnel formed in the cover disc, a narrow side of the first funnel facing the metering disc and a wide side of the first funnel facing the inner thread;

a second funnel formed in the plate, a narrow side of the second funnel facing the downwardly protruding tube and a wide side of the second funnel facing the metering disc; and a counting unit for counting and displaying a number of changes in position of the metering chambers.

8. A method, comprising:

providing the device according to claim 7;

providing the medicament container filled with the medicament in form of granules, pellets, or microcapsules;

removing a screw lid from the medicament container;

screwing the device, in an upside-down orientation, onto the medicament container;

pushing the drinking straw onto the downwardly protruding tube;

turning the device such that the medicament container is in an upside-down orientation; and rotating the metering disc.

* * * * *